United States Patent [19]

Guarnere

[11] 4,056,903

[45] Nov. 8, 1977

[54] WALL SUPPORT MECHANISM FOR ADJUSTING THE VERTICAL ORIENTATION AND HEIGHT OF A WALL MEMBER

[75] Inventor: Joseph V. Guarnere, Rochester, N.Y.

[73] Assignee: TIW Industries, Inc., Rochester, N.Y.

[21] Appl. No.: 698,486

[22] Filed: June 21, 1976

[51] Int. Cl.[2] ..... E04B 2/72; A47G 5/00

[52] U.S. Cl. ..... 52/122; 52/27; 52/239; 160/351; 248/188.2; 248/188.4

[58] Field of Search ..... 248/188.2, 188.3, 188.4; 403/160; 52/27, 122, 239; 160/135, 351

[56] References Cited

U.S. PATENT DOCUMENTS

| | | | |
|---|---|---|---|
| 611,260 | 9/1898 | Lamoureux | 248/188.4 |
| 2,535,613 | 12/1950 | Vanderbeek | 248/188.4 |
| 2,949,984 | 8/1960 | Daniels | 248/188.4 |
| 3,021,638 | 2/1962 | Kristek | 248/188.2 |
| 3,028,703 | 4/1962 | Matter | 248/188.3 |
| 3,204,689 | 9/1965 | Howell | 160/135 |

*Primary Examiner*—Alfred C. Perham
*Attorney, Agent, or Firm*—Cumpston & Shaw

[57] ABSTRACT

A wall support mechanism for vertically supporting a wall member such as an acoustical screen, room partition, or the like, on a non-horizontal floor substantially perpendicular to a reference horizontal plane or parallel to a vertical gravity plumb line. The support mechanism further adjusts the height of the wall member. The support mechanism comprises an elongated foot member and a conduit coupled to the wall member and having an inclined end per se or a tilted nut secured to the conduit end with the lower surfaces of the conduit end or nut lying in a plane inclined to the axis of the conduit. The inclined end of the conduit or nut rests on the center portion of the foot member and vertically orients the conduit and wall member relative to the reference plane upon manual rotatable movement of the conduit and nut relative to the foot member. The conduit is releasably secured to the foot member by a locknut and bolt arrangement.

11 Claims, 7 Drawing Figures

A
12
14
22
24
26
28
30
32
34
36
38
40
42
44
46
48
50
52
54
56
58
72
74
76
78
80
82
84
86

WALL SUPPORT MECHANISM FOR ADJUSTING THE VERTICAL ORIENTATION AND HEIGHT OF A WALL MEMBER

BACKGROUND OF THE INVENTION

1. Field of the Invention

This invention relates generally to wall support mechanisms, and more specifically to an improved wall support mechanism for vertically supporting a wall member substantially perpendicular to a reference horizontal plane that extends transverse to the longitudinal axis of the wall member. The support mechanism further adjusts the height of the wall member from the floor for supporting the wall member substantially perpendicular to a second horizontal plane that extends along the longitudinal axis of the wall member.

2. Description of the Prior Art

It is known in the prior art to vertically support wall members such as acoustical screens by one or more unitary wall support members. The wall support members each comprise an elongated foot member that rests on the floor and a tubular member perpendicular to the foot member and having one end rigidly secured to the center portion of the foot member and its opposite end fastened or coupled to the wall member. Such wall support members work very well in those situations where the floor supporting the members lies in a substantially horizontal plane. However, in many buildings the floor is not horizontal or level, and hence wall members supported by such prior are support members will be inclined to the vertical and not substantially perpendicular to a reference horizontal plane or parallel to a gravity plumb line as desired. This is, of course, unacceptable from aesthetic and other standpoints. To vertically orient the wall member transverse to its longitudinal axis, it is necessary to place shims or to provide leveling screws under one or both of the ends of each of the supporting foot members. The shims are unsightly and have a tendency to become displaced from their position if the wall member is accidentally jarred or bumped. The leveling screws are difficult to adjust and in addition raise the end of the foot member from the floor which is aesthetically undesirable.

In regard to leveling screws generally, it is further known in the art, of which U.S. Pat. Ser. Nos. 611,260; 842,641; and U.S. Pat. No. 2,010,299 are exemplary, to provide leveling screws at the bottom of table legs to adjust the height of a table and to level it. Although these leveling screws operate satisfactorily for objects having four legs, they are completely unsuitable for vertically supporting a two-legged object such as a wall member substantially perpendicular to a horizontal plane or parallel to a vertical gravity plumb line. The reason for this is that the leveling screws move the legs supported thereby substantially only in a vertical direction, whereas angular movement of the legs is required for a two-legged object. A further disadvantage of the prior art wall support members for two-legged wall members is that no means are provided for adjusting the height of the wall member from the floor. This feature of wall height adjustability for wall members is desirable for one or more reasons such as leveling the top and bottom edges of the wall members, clearing obstacles on the floor, or providing increased office privacy by increasing the height of the wall members.

SUMMARY OF THE INVENTION

In accordance with preferred embodiments of the invention, a wall support mechanism is disclosed for vertically supporting a wall member such as an acoustical screen, room partition, or the like, on a non-horizontal floor substantially perpendicular to a reference horizontal plane that extends transverse to the longitudinal axis of the wall member. The wall support mechanism is further capable of adjusting the height of the wall member relative to the floor for supporting the wall member substantially perpendicular to a second horizontal plane that extends along the longitudinal axis of the wall member.

More specifically, the wall support mechanism comprises a foot member mountable on a non-horizontal floor in substantially parallel relation thereto. A conduit is provided having an inclined end lying in a plane inclined relative to the axis of the conduit. The inclined end rests upon or abuts the central portion of the foot member and vertically orients the conduit in a plane substantially perpendicular to a horizontal plane or parallel to a vertical gravity plumb line, when viewed from the end of the wall member, upon manual rotatable movement of the conduit relative to the foot member to a selected position. Although means are provided for releasably securing the conduit to the foot member to initially allow rotatable movement of the conduit relative to the foot member and then to rigidly secure the conduit in the selected vertically oriented position, in certain preferred embodiments the conduit may be rotated relative to the foot member without the necessity of loosening the securing means, thereby facilitating the above adjustments. The wall support mechanism is further provided with means for supporting a part of the wall and for adjusting the height of the wall member.

In a more specific embodiment of the invention, the conduit comprises a tube having a nut secured to the lower end with its lower surface lying in a plane inclined to the axis of the conduit. The means for securing the nut and tube to the foot member comprises a bolt insertable through openings in the foot member and nut. The bolt is preferably secured to the nut, and a lock-nut threaded on the bolt end for compressing a spring preferably interposed between the lock-nut and base member. Accordingly, compressing the spring by the lock-nut imparts a force urging the inclined end of the nut into frictional engagement with the foot member. The advantage of this arrangement is to facilitate rotatable movement of the tube on the foot member for vertically orienting the tube in a plane parallel to a gravity plumb line. Where means are provided for rotating the tube elative to the foot member, the above adjustments can be made without loosening the lock-nut. In another embodiment, the lock-nut is loosened before the adjustment is made. Once the adjustment is achieved, the lock-nut is tightened to further compress the spring and in effect to rigidly secure the tube to the foot member.

The means coupled to the wall member for adjusting the height of the wall member comprises a threaded rod secured to the tube in mating engagement with a threaded insert in the wall member.

The advantage of this invention, among others, is to vertically adjust or "plumb" a wall member when viewed from the end of the wall member quickly and easily, and without any unsightly adjusting members. This adjustment can be made without lifting the foot or wall member and without loosening the means for releasably securing the conduit to the foot member. Another advantage is to also provide means for adjusting the height of the wall member, which adjustment can be utilized to vertically adjust the wall member when viewed from the side. The invention and these and other advantages will become more apparent from the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
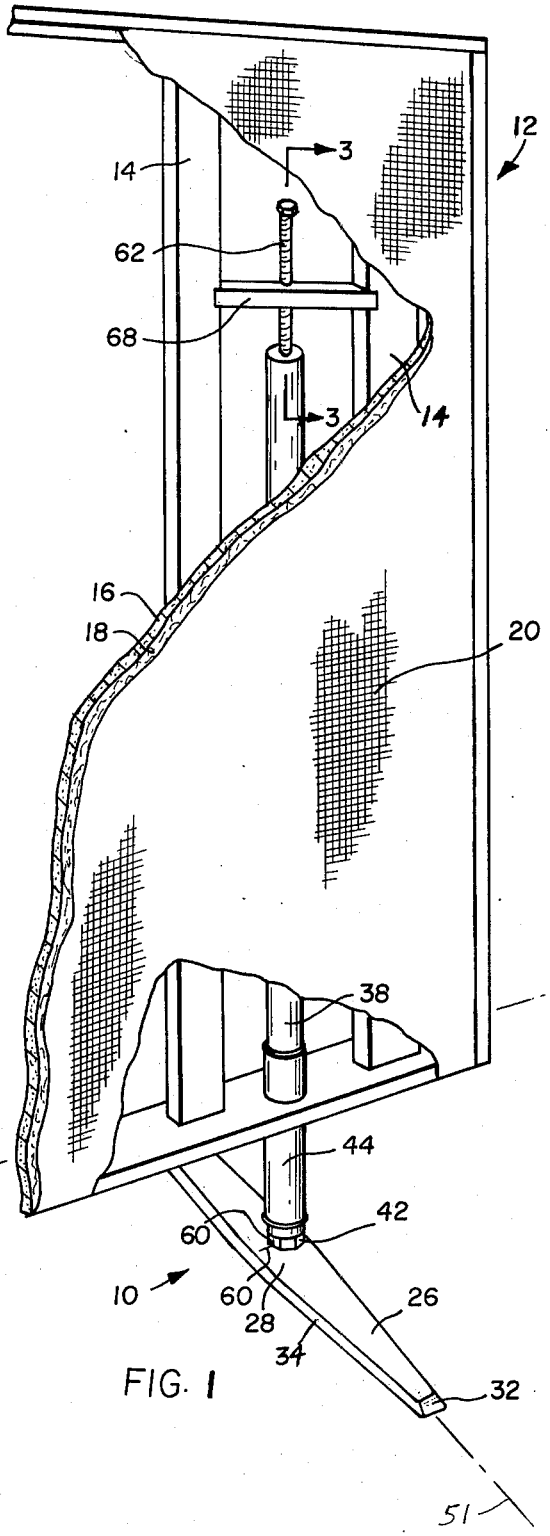
FIG. 1 is a segmental view in perspective of a preferred embodiment of a wall support mechanism of this invention supporting one end of a wall member.
Figures 2, 4, 5:
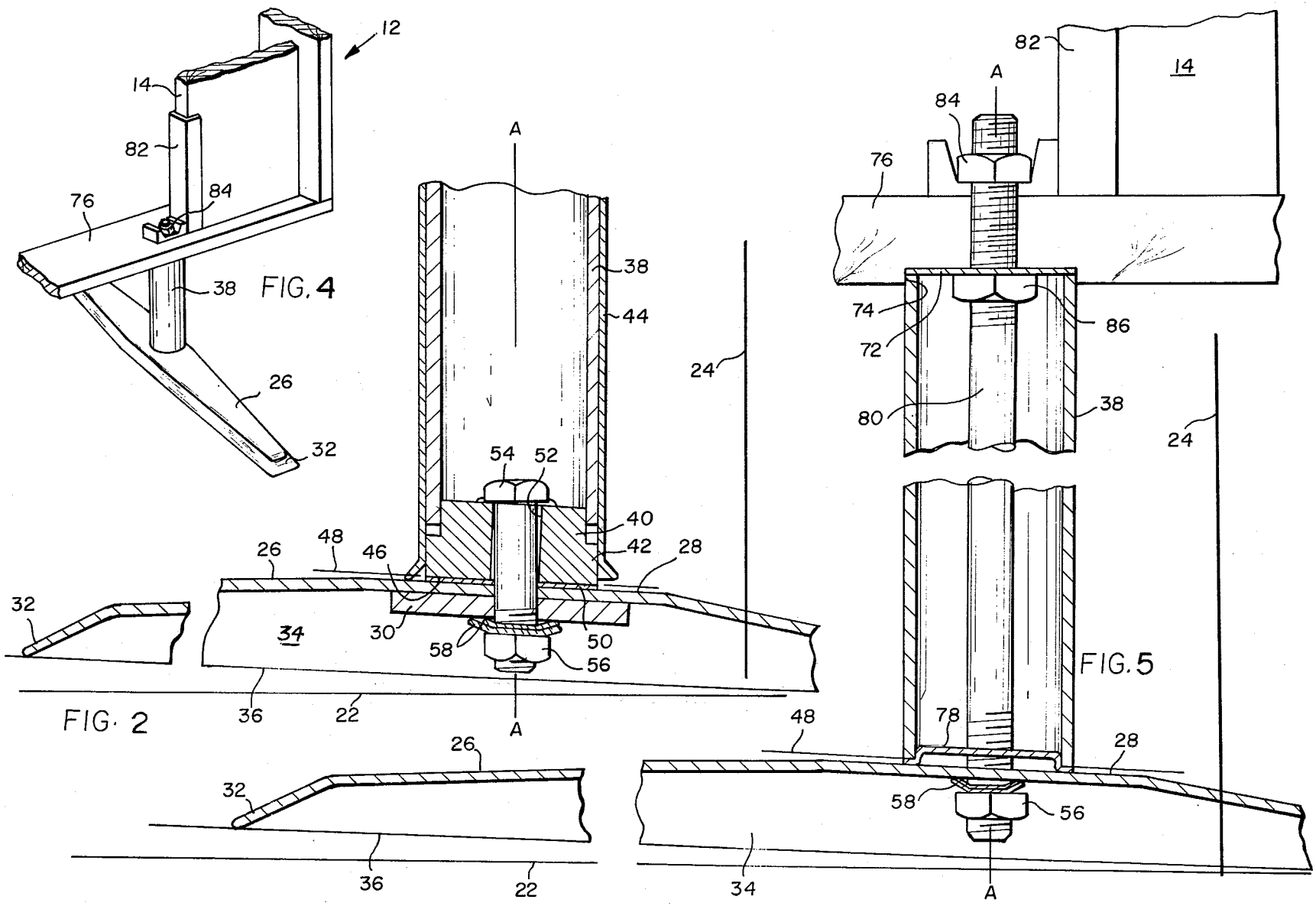
FIG. 2 is a segmental enlarged side elevational view in section of the wall support mechanism of FIG. 1.
FIG. 4 is a segmental perspective view of another embodiment of the wall support mechanism of this invention.
FIG. 5 is a segmental enlarged side elevational view in section of the wall support mechanism shown in FIG. 4.

With reference to FIGS. 1 and 2 of the drawings, a preferred embodiment of a wall support mechanism 10 is disclosed for vertically supporting one end of a wall member 12 such as an acoustical screen, room partition, or the like. Such wall members 12 may comprise an interior core comprising studs 14, and on each side of the member a septum 16 covering the core, an acoustical padding 18 covering the septum and a fabric face 20 covering the padding. Normally, a pair of wall support mechanisms 10 are needed to support opposite ends of wall member 12 on a non-horizontal floor (FIG. 2) and to orient the wall member substantially perpendicular to a reference horizontal plane 22 or parallel to a reference vertical gravity plumb line 24 achieved by attaching a weight to the end of an upheld string. These wall support mechanisms 10 are further adapted to adjust the height of wall member 12.

More specifically, the wall support mechanism 10 illustrated in FIGS. 1-2 comprises a foot plate member 26 preferably stamped out of a steel plate and having a central horizontal plate portion 28 reinforced by a backup plate 30 secured thereto. Foot plate 26 has end and side wall portions 32, 34 respectively adapted to rest on a floor 36. As seen in FIG. 2, floor 36 lies substantially in a plane which is non-horizontal or inclined relative to reference horizontal plane 22 which is often the case in older buildings, the inclination being shown in exaggerated form in FIG. 2 for purposes of clarity.

A conduit 38 shown as a cylindrical tube has one end secured by welding or the like to a cylindrical shoulder 40 of a hexagonal nut 42. Nut 42 extends radially from tube axis A—A a distance substantially equal to or less than the outer radius of tube 38. A finished decorative thin walled sleeve 44 encircles tube 38 and nut 42 and is slidably movable between a normal position as seen in FIG. 2 in which it rests on central portion 28 of foot plate member 26 and covers nut 42, and a raised position as seen in FIG. 1 in which it provides access to nut 42. Nut 42 is welded to tube 38 in an inclined position so that the lower surface 46 of the nut lies in a plane 48 inclined relative to tube axis A-A.

The inclined surface 46 abuts or rests directly on foot plate portion 28 or preferably on an antifriction washer 50, and upon rotation of tube 38 its axis A—A will define a cone-shaped path at all times non-perpendicular to plate portion 28. However, when a wall member 12 is coupled to a pair of tubes 38, the pair of tubes are at all times held by the wall member in the plane of the wall member and in positions parallel to one another and perpendicular to the longitudinal axis 49 (FIG. 1) of the wall member. If foot plates 26 are inclined relative to horizontal plane 22 (FIG. 2) along a transverse axis 51 (FIG. 1) is substantially perpendicular to said longitudinal axis 49 due to a non-horizontal floor support 36, wall member 12 and tubes 38 will be non-perpendicular to horizontal plane 22, when viewed from the end of the wall member; i.e., along longitudinal axis 49. However, it is possible by rotating nuts 42 and tubes 38 to selected positions to vertically orient the wall member and tubes to lie perpendicular to horizontal plane 22 when viewed along longitudinal axis 49. If it is necessary to level the wall member along axis 49, tubes 38 are shortened or lengthened relative to the wall member by height adjusting means hereinafter described.

Nut 42 of each support mechanism is preferably provided with a central opening 52 for receiving a threaded bolt 54 having a diameter less than the diameter of opening 52. This allows bolt 54 to be tilted in opening 52 until its axis coincides with tube axis A—A and then welded in place. The plates 28, 30 are provided with central openings through which bolt 54 is inserted. The tube 38 and nut 42 are secured to plate 26 by a lock-nut 56 compressing a pair of Bellville spring washers 58 interposed between lock-nut 56 and plate 30. With spring washers 58 substantially compressed, it is possible to manually rotate nut 42 by any suitable wrench or pliers until, as explained earlier, tube axis A—A and wall member supported thereby lies in a plane vertically oriented relative to reference horizontal plane 22 or parallel to vertical gravity plumb line 24. Because of the resiliency of washers 58, when tube 38 is in its vertically oriented position, it will remain in its adjusted position on foot plate 26 without the necessity of further tightening lock-nut 56.

To facilitate the above adjustment and minimize the angle through which nut 42 and tube 38 are turned to achieve vertical orientation, tube 38 and foot plate portion 28 are provided with indicia 60 (FIG. 1) that match when the tube axis A—A lies in a plane perpendicular to foot plate portion 28 when viewed along longitudinal axis 49 of the screen. In that position, the support mechanism, when mounted on a floor 22 that is horizontal along axis 51, will support wall member 12 perpendicular to the floor along said transverse axis 51. Since the tube axis A—A is held perpendicular to the above longitudinal axis of the wall member as a result of its mounting relative to the wall member, as indicated earlier, foot member 26 is tilted imperceptably relative to horizontal plane 22 when the mechanism is mounted on a surface that is horizontal along axis 51. When the support mechanism is mounted on a surface that is not horizontal along axis 51, the nut and tube need be turned through only a small angle from the indicia to vertically orient the tube axis and wall member, when viewed from the end of the wall member.

Figure 3:
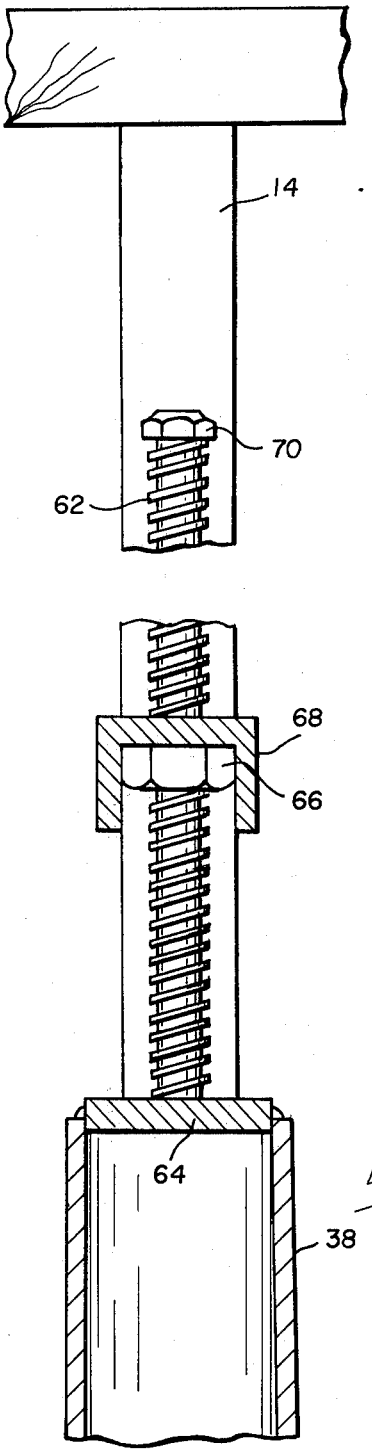
FIG. 3 is an enlarged view in section taken substantially along line 3—3 of FIG. 1.

With reference to FIGS. 1 and 3, the height adjusting mechanism for wall member 12 comprises a threaded rod 62 secured by welding or the like to an end plate 64 on tube 38. The rod 62 threadedly engages a nut 66 secured by welding to a channel 68 which is fastened by any suitable means to spaced studs 14 of wall member 12. The channel 68 has an opening in register with the nut opening to allow passage of threaded rod 62. In operation, rotation of nut 42 and tube 38 in one or the other direction causes tube 38 to move into or extend further from wall member 12 to raise or lower that end of the wall member. This allows the wall member to be leveled along longitudinal axis 49, thereby leveling the wall member when viewed from the side. A lock member 70 at the end of rod 62 provides a stop to prevent disengagement of the rod from nut 66.

In the embodiment of the invention shown in FIGS. 4 and 5, parts similar to parts described heretofore will be designated by the same numbers. In this embodiment, the upper end of tube 38 seats against a steel plate 72 in a recess 74 in bottom plate 76 of wall member 12. The lower end of tube 38 is cut at a slight angle so that the end lies in plane 48 inclined to axis A—A of tube 38. The tube end rests on a brass thrust washer 78 when in turn rests on foot plate portion 28. The tube 38 is secured to foot plate 26 by a threaded rod 80 extending through openings in a corner bracket 82, plates 76, 72, and 28 and washer 78. A nut 84 is threaded on rod 80 into engagement with bracket 82 which is secured to a stud 14 on wall member 12. A lock-nut 86 on rod 80 bears against plate 72 and secures corner bracket 82 and plates 76, 72 along with a fabric edge interposed therebetween, together as a unit. Another lock-nut 56 is threaded onto the lower end of rod 80 and compresses a pair of Bellville spring washers 58 interposed between foot plate center portion 28 and lock-nut 56. Although FIG. 5 does not include a reinforcing plate such as that shown at 30 in FIG. 2, such a plate may be used if desired. Since there are no means provided for gripping tube 38, except by a pipe wrench which would mar its outer surface, or by hand, when it is desired to adjust the vertical orientation of wall member 12, it may be necessary to loosen lock-nut 56 before making the adjustment. After lock-nut 56 is loosened, tube 38 may be rotated by hand to its desired position, and lock-nut 56 tightened to rigidly secure tube 38 to center portion 28 of foot member 26. In this embodiment, no means are provided for adjusting the height of wall member 12.

Figures 6, 7:
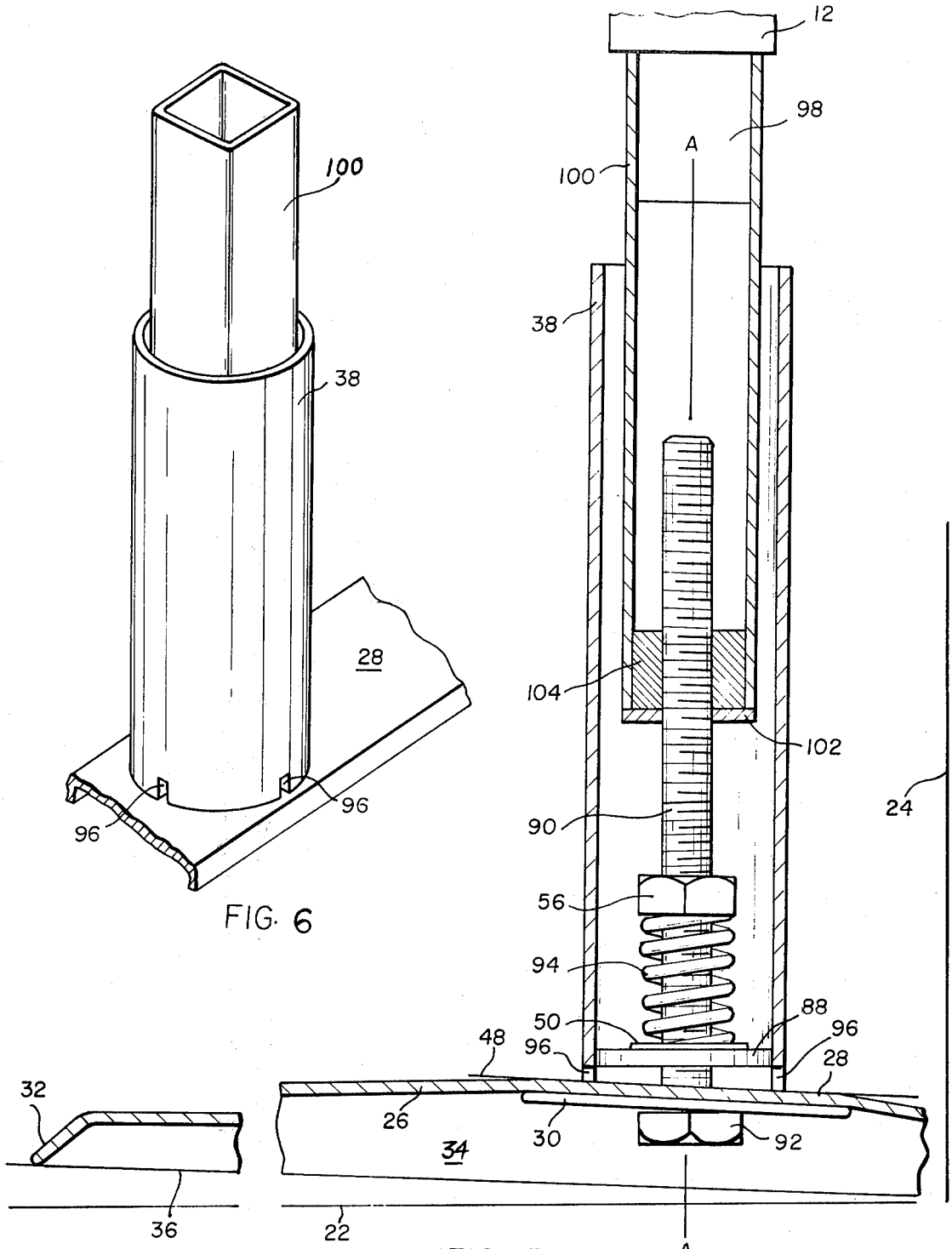
FIG. 6 is a segmental view in perspective of still another embodiment of the invention.
FIG. 7 is an enlarged side elevational view in section of the embodiment of FIG. 6.

With reference to FIGS. 6 and 7, still another embodiment of the wall support mechanism 10 is disclosed in which parts similar to previously described parts are designated by the same numbers wherein the above described adjustment can be made without first loosening the connecting means, i.e., lock-nut 56. In this embodiment, tube 38 has one end open and its opposite or lower end is cut at a slight angle to its longitudinal axis so that it lies in a plane 48 inclined to tube axis A—A. An end plate 88 is welded to tube 38 adjacent one end, and lies in a plane perpendicular to tube axis A—A. A threaded bolt 90 extends through openings in foot plate center portion 28 and backup and end plates 30, 88, respectively, with bolt head 92 engaging the bottom of plate 30. An antifriction washer 50 and helical spring 94 encircles bolt 90, and lock-nut 56 on bolt 90 compresses the spring for urging the tube end into frictional engagement with foot plate center portion 28. As with the modification shown in FIGS. 1-3, with spring 94 substantially compressed, tube 38 can be manually rotated until tube axis A—A and any wall member supported thereby lies in a plane perpendicular to horizontal plane 22 when viewed along said previously described longitudinal axis 49. To facilitate rotation of tube 38, it is provided with slots 96 (FIG. 6) engagable by any suitable spanner tool, not shown. Once tube 38 is vertically oriented, it will remain in that position until tube 38 is rotated relative to foot plate 26.

The portion of the support mechanism 10 for supporting a part such as a leg 98 (FIG. 7) of a wall member 12 and for adjusting the height of the wall member comprises a second conduit 100 shown as a square tube which can extend upwardly into wall member 12 where it is securely fixed by suitable means (not shown). Tube 100 is preferably of such cross-sectional dimension that it forms a snug fit within tube 38 so as to minimize any rocking movement between tubes 100 and 38 while allowing tube 38 to be rotated relative to tube 100.

Tube 100 has one end closed off by an end plate 102, and further has a square threaded insert 104 of substantially the same shape as the inner periphery of tube 100 in engagement with end plate 102. The insert 104 is preferably secured to tube 100 and/or plate 102 by any suitable means such as welding or the like. The plate 102 has an opening in register with a threaded opening in insert 104 for receiving threaded bolt 90 when tube 100 and insert 104 as a unit is screwed thereon. Accordingly, by varying the vertical position of tube 100 and insert 104 on bolt 90, the height of a wall member 12 which is shown coupled or fastened to the tube, e.g. by a leg 98 resting within the open end of the tube, can be adjusted.

Thus, it will be seen that the invention discloses means for quickly and easily adjusting the vertical position of a leg or support member on a non-horizontal surface to "plumb" the leg member. In the embodiments shown in FIGS. 1-3 and 6 and 7, this adjustment can be done without lifting the wall member and without loosening the means connecting the leg member to the foot plate. While in the remaining embodiment, this adjustment could also be made without loosening the connecting means, it may be difficult to rotate the leg member relative to the foot plate without first loosening the connecting means.

The invention has been described in detail with particular reference to preferred embodiments, but it will be understood that variations and modifications can be effected within the spirit and scope of the invention as described. For example, although conduit 38 is shown as a cylindrical tube, it can be of any other configuration such as square or the like. Also, although conduit 100 is shown as a square tube, it can conceivably also be cylindrical or of some other suitable configuration.

What is claimed is:

1. A support mechanism for vertically supporting a wall member such as an acoustical screen, room partition, or the like substatially perpendicular to a reference horizontal floor comprising:

a foot member mountable on a non-horizontal floor and having a central plate portion in substantially parallel relation thereto; and a unitary conduit coupled to the wall member and having one end of said unitary conduit rigidly secured to said unitary conduit, said one end having a surface lying in a plane inclined to the axis of said conduit, said surface of said one end abutting said central plate portion of said foot member for vertically orienting said conduit and a wall member supported thereby in a plane substantially perpendicular to said reference horizontal floor upon rotatable movement of said conduit and said one end thereof on said central plate portion of said foot member to a selected position;

said conduit further being releasably secured to said foot member in said selected position.

2. The support mechanism of claim 1 comprising a nut rigidly secured to said one end, said nut having a lower surface lying in a plane inclined to the axis of said conduit.

3. The support mechanism of claim 1 comprising a nut having a shoulder recessed within said one end of said conduit and ridgidly secured thereto with the axis of said nut inclined to the axis of said conduit whereby the lower surface of said nut lies in a plane inclined to the axis of said conduit.

4. The support mechanism of claim 3 wherein said nut has a body portion extending from said conduit, said outer periphery of said body portion radially extending from the axis of said conduit a distance substantially equal to the radius of said outer periphery of said conduit, and a sleeve slideably mounted on said conduit for covering and uncovering said nut.

5. The support mechanism of claim 4 wherein said nut and said foot member have aligned openings, and said conduit is releasably secured to said foot member by a bolt extending through said openings, a spring encircling said bolt, and a lock-nut on said bolt for compressing said spring and securing said nut and conduit to said foot member.

6. The support mechanism of claim 5 wherein said conduit comprises a tube, said foot member is an elongated plate member having said central plate portion spaced from the floor for supporting said tube, said shoulder of said nut is cylindrical, said body portion of said nut has a non-circular outer periphery, said spring comprises a Bellville spring washer, and said bolt is rigidly secured to said nut with its axis coincident with the axis of said tube.

7. The support mechanism of claim 5 and further comprising means for adjusting the height of the wall member, said adjusting means comprising a threaded rod secured to the opposite end of said conduit with the axis of said rod coincident with the axis of said conduit, and a second nut secured to the wall member for threaded engagement with said rod.

8. The support mechanism of claim 1 in combination with the wall member wherein the wall member has a bottom plate and a first opening through said bottom plate, said conduit has its opposite end abutting said bottom plate and encircling said first opening, said foot member has a second opening, and said securing means comprises a threaded member extending through said first and second openings, a lock-nut on said threaded member, and a spring encircling said threaded member and interposed between said foot member and said lock-nut.

9. The support mechanism according to claim 8 wherein said conduit is a tube, said bottom plate is provided with a recess and said first opening extends through said recess, said opposite end of said tube is seated in said recess, said threaded member comprises a bolt, and said spring comprises a Bellville spring washer.

10. The support mechanism according to claim 1 wherein said foot member is elongated, said conduit has an end plate adjacent said inclined end, said end plate lying in a plane perpendicular to said axis of said conduit, said end plate and said foot member having registering openings, and said conduit is releasably secured to said foot member by a threaded member insertable through said openings with a first portion of said threaded member abutting said foot member on one side of said end plate, a second portion of said threaded member on the opposite side of said end plate, and a spring interposed between said second portion and said end plate.

11. The support mechanism according to claim 10 and further comprising means mounted on said threaded member for supporting and adjusting the height of the wall member, said supporting and adjusting means comprising a tube rotatable within said conduit, one end of said tube adapted to be coupled to the wall member, and a threaded insert at the opposite end of said tube in threaded engagement with said threaded member.

* * * * *